US005261172A

United States Patent [19]

Rowley

[11] Patent Number: 5,261,172

[45] Date of Patent: Nov. 16, 1993

[54] 3-D GREETING CARD

[75] Inventor: Susan E. Rowley, Des Plaines, Ill.

[73] Assignee: Rowley Corporation, Des Plaines, Ill.

[21] Appl. No.: 899,774

[22] Filed: Jun. 17, 1992

[51] Int. Cl.[5] ..... G09F 1/00

[52] U.S. Cl. ..... 40/124.1; 40/160; 428/13

[58] Field of Search ..... 428/13; 40/124.1, 539, 40/160

[56] References Cited

U.S. PATENT DOCUMENTS

| | | | |
|---|---|---|---|
| 565,450 | 8/1896 | Gibson | 40/539 |
| 2,544,783 | 3/1951 | Freedman et al. | 428/13 |
| 4,774,780 | 10/1988 | Crowell | 40/124.1 |

FOREIGN PATENT DOCUMENTS

| | | | |
|---|---|---|---|
| 489883 | 8/1938 | United Kingdom | 40/539 |

*Primary Examiner*—Kenneth J. Dorner
*Assistant Examiner*—C. Hope Davis
*Attorney, Agent, or Firm*—Willian Brinks Olds Hofer Gilson & Lione

[57] ABSTRACT

A three dimensional greeting card that has its three dimensional aspect on the front face of the greeting card. The greeting card has a front panel, a rear panel joined to the front panel, and a shelf attached to the front face of the front panel so that a character object may rest on the upper side of the shelf.

10 Claims, 2 Drawing Sheets

3-D GREETING CARD

BACKGROUND OF THE INVENTION

The present invention relates to a three dimensional greeting card. Greeting cards that expand or "pop" into a three dimensional aspect when opened are well known. The problem with these types of greeting cards is that the recipient must open the card to view the three dimensional aspect of the card. Furthermore, because the three dimensional aspect is contained in the inner portion of the card, the surface for writing is virtually nonexistent.

Accordingly, there is a need for a three dimensional greeting card having an adequate space for containing a greeting or other personalized writing. In accordance with the present invention, a three dimensional aspect is incorporated onto the front face of the greeting card so that the inner portion of the card can contain a greeting or other personalized writing. Moreover, the recipient is able to view the three dimensional aspect of the greeting card upon receipt rather than having to open the card.

SUMMARY OF THE INVENTION

The present invention provides a greeting card having a three dimensional aspect on its front face. The greeting card comprises a front panel with one edge of the front panel being joined to a like edge of a rear panel; a shelf attached to the front face of the front panel, the shelf having an upper side and a lower side; and a character object resting on the upper side of the shelf.

DETAILED DESCRIPTION OF THE INVENTION AND PREFERRED EMBODIMENTS

Figure 1:
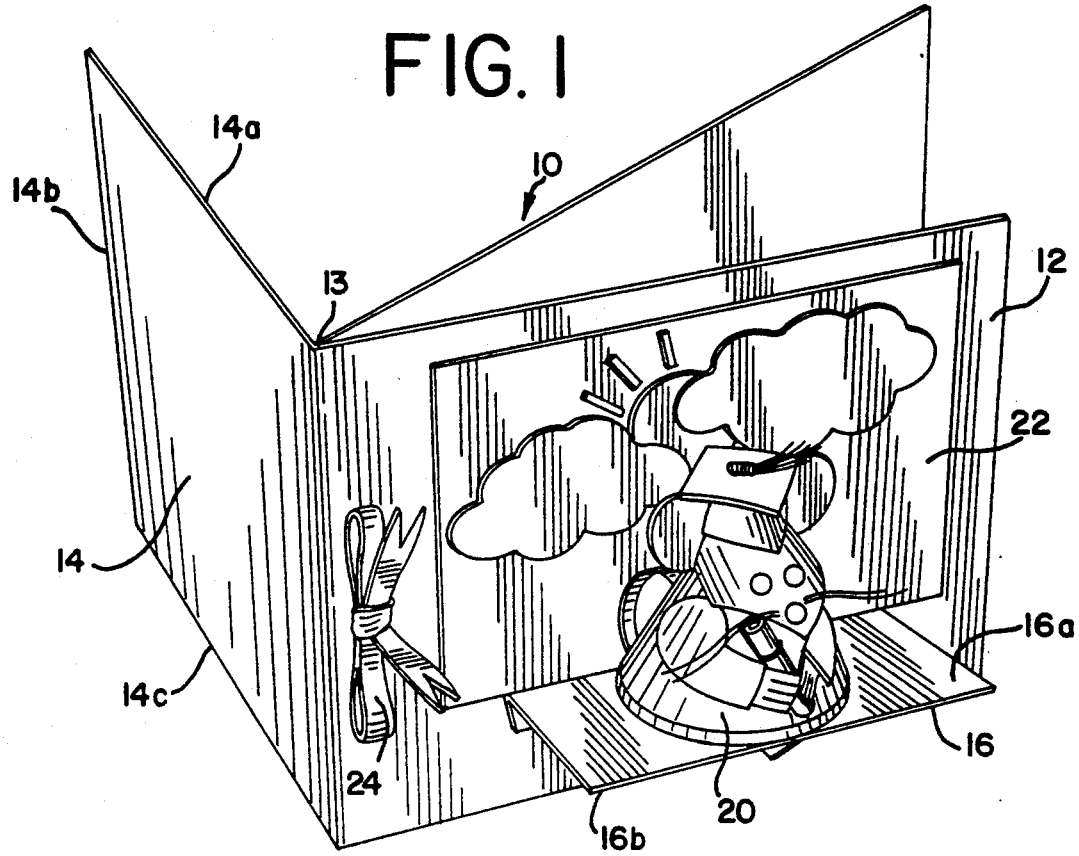
FIG. 1 is a perspective view of a greeting card according to one embodiment of the invention in which the card is an open position.

FIG. 1 shows a greeting card of the present invention. Although greeting cards are typically manufactured from paper, paper stock, and the like, it is contemplated that the greeting card can be manufactured from any material subject to manufacturing considerations and which may be desirable to the recipient. For example, the card may be manufactured from paper, wood, plastic, metal and the like. For ease of description, the greeting card of the present invention will be described as being manufactured from paper.

The greeting card depicted in FIG. 1 is shown as rectilinear. It is contemplated, however, that any suitable shape may be used such as circular, oblong, semicircular, square, triangular and the like. For ease of description, however, the greeting card of the present invention will be described as having a rectangular shape. As shown in FIG. 1, the greeting card 10 has a front panel 12, with a front face and a rear face (not shown). The front panel has four edges generally defined as a top edge 12*a*, a first side edge 12*b*, a bottom edge 12*c*, and a second side edge 12*d*. It is seen that when the front face of the front panel is facing the viewer or recipient the first side edge 12*b* is on the recipient's right hand. Thus, the first side edge 12*b* may also be identified as the right-hand edge 12*b*. In a like manner, second side edge 12*d* is on the recipient's left hand and so it may also be identified as the left-hand edge 12*d*.

As noted above, the front panel may have any desirable size and shape according to consumer preferences. Of course, when the greeting card 10 has a shape other than rectangular, there may be a continuous edge as with a circular shaped card 10 or only three edges where the card 10 is triangular shaped. Where, however, the card is rectangular as shown in FIG. 1, the distance between 12*b* and 12*d* can be longer than the distance between 12*a* and 12*c*, although the distance may be the same or the distance between 12*b* and 12*d* may be shorter than the distance between 12*a* and 12*c*.

The greeting card 10 also has a rear panel 14, with a front face (not shown) and a rear face. Generally, the rear panel has substantially the same shape and dimensions as the front panel. When, as is shown in FIG. 1, the card 10 is rectilinear, the rear panel has four edges generally defined as a top edge 14*a*, a first side edge 14*b*, a bottom edge 14*c*, and a second side edge 14*d*.

Figure 2:
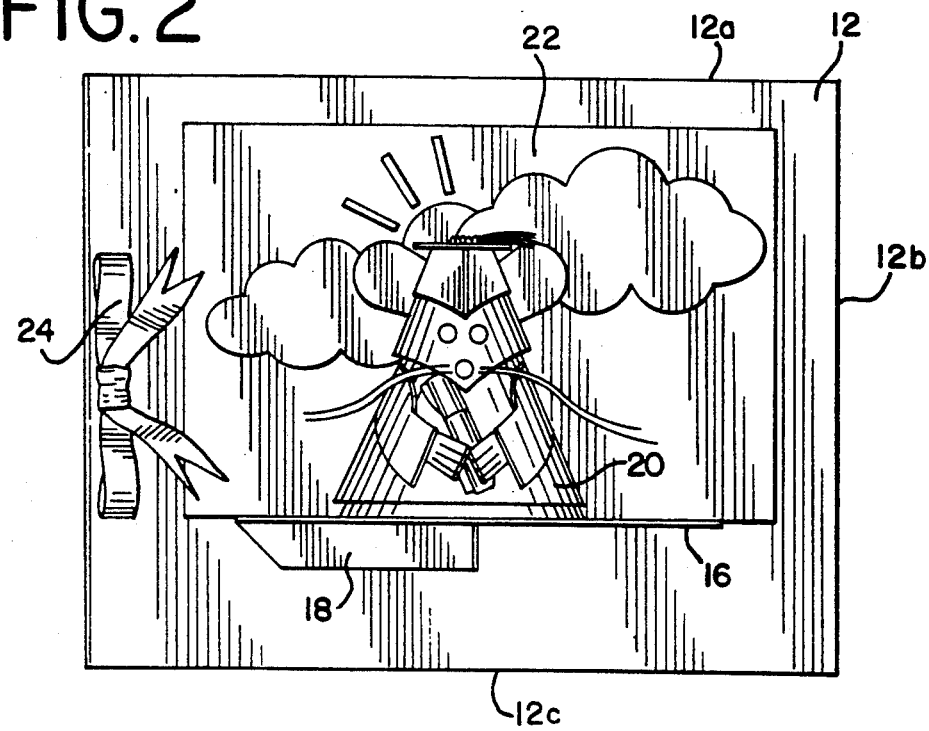
FIG. 2 is a plan view of a greeting card according to one embodiment of the invention.

When the greeting card 10 is in a closed position, the rear panel edges 14*a–d* are substantially aligned with the front panel edges 12*a–d*. Of course, if the card is of another shape, the rear panel edge or edges will be substantially aligned with the front panel edge or edges when the card is in the closed position. Thus, when the card is in the closed position it is desirable that the rear panel and front panel are substantially aligned so that when the card is viewed, as shown in FIG. 2, the appearance is of a single panel. It is, however, to be understood that it is not necessary that the rear panel and front panel be substantially aligned when the card is in a closed position.

It will also be noticed that when the greeting card 10 is in the closed position, the front face of the rear panel 14 may contact the rear face of the front panel 12. Of course, it is well known to those skilled in the art to provide for a "pop" up three dimensional aspect or to provide decorative or filler sheets between the rear face of the front panel and the front face of the rear panel (i.e., on the inside of the card). Accordingly, it is contemplated that greeting card 10 may contain such a three dimensional aspect or decorative filler sheets.

Where a filler sheet is provided, it may be affixed to the front face of the rear panel, the rear face of the front panel or to hinge area on the inside of the card. Of course, the filler sheet may comprise one or more sheets as may be desirable and can be affixed by any well known means such as by staples, adhesive, and the like.

As shown in FIG. 1, when the greeting card is in a closed position, the first side edge 14*b* is on the recipient's right hand. Thus, the first side edge 14*b* may also be identified as the right-hand edge 14*b*. In a like manner, second side edge 14*d* is on the recipient's left hand and so it may also be identified as the left-hand edge 14*d*.

FIG. 1 shows the front panel 12 and the rear panel 14 of greeting card 10 as one piece being hinged along hinge line 13. In this case, the left edge 12*d* and the left edge 14*d* coexist along hinge line 13. Of course, a similar hinge can be provided so that other like edges coexist. For example, the card 10 could be hinged at the top so that top edges 12*a* and 14*a* coexist along a hinge line similar to hinge line 13. When the card 10 is not rectilinear, the card 10 may also be hinged along any suitable edge so that like edges of the front panel and rear panel coexist.

FIG. 1 also shows that the greeting card 10 is hinged from top edge 12*a* to bottom edge 12*c*. It is to be understood that the hinge need not extend the entire length from one edge to another.

It is contemplated that the front panel 12 and the rear panel 14 can be separate and that a means for joining like edges (i.e. the left edge 12*d* and the left edge 14*d*) be used. Of course, any such like edges (12*a* and 14*a*, 12*b* and 14*b*, 12*c* and 14*c*) can be joined. When the front panel and the rear panel are separate, suitable like edges will be joined. Thus, where the card is a triangle having a front panel with three edges and a rear panel with three edges, any of the like edges may be joined. As with the hinge, the entire length of the like edges need not be joined and in some cases it may be preferable to only join a portion of like edges.

The joining means can include, but are not limited to, adhesives such as tape and glue, staples, clips, string, as well as other well known devices for joining two pieces of paper or like articles.

The three dimensional aspect is provided on the front of the greeting card 10 by a shelf 16. The shelf has an upper or top side 16*a* and a lower or under side 16*b* (not shown). In one embodiment, the shelf 16 has a rectangular shape wherein one edge is attached to the front face of the front panel 12. Of course, other shapes may be used and include, but are not limited to, shapes such as a semi-circle or a triangle. It will be appreciated that in order for the shelf 16 to be suitably attached to the front face of the front panel 12, one edge of the shelf 16 should be substantially linear.

As noted, the shelf could have any suitable dimension. It is preferred, however, that the length of the shelf be less than the length between edges 12*b* and 12*d*.

The shelf 16 can be attached to the front face of the front panel 12 by any suitable means. For example, where paper is used, the shelf 16 can be attached, along one of its edges, to the front face of the front by adhesive, glue, adhesive tape, staples, and the like.

Figure 3:
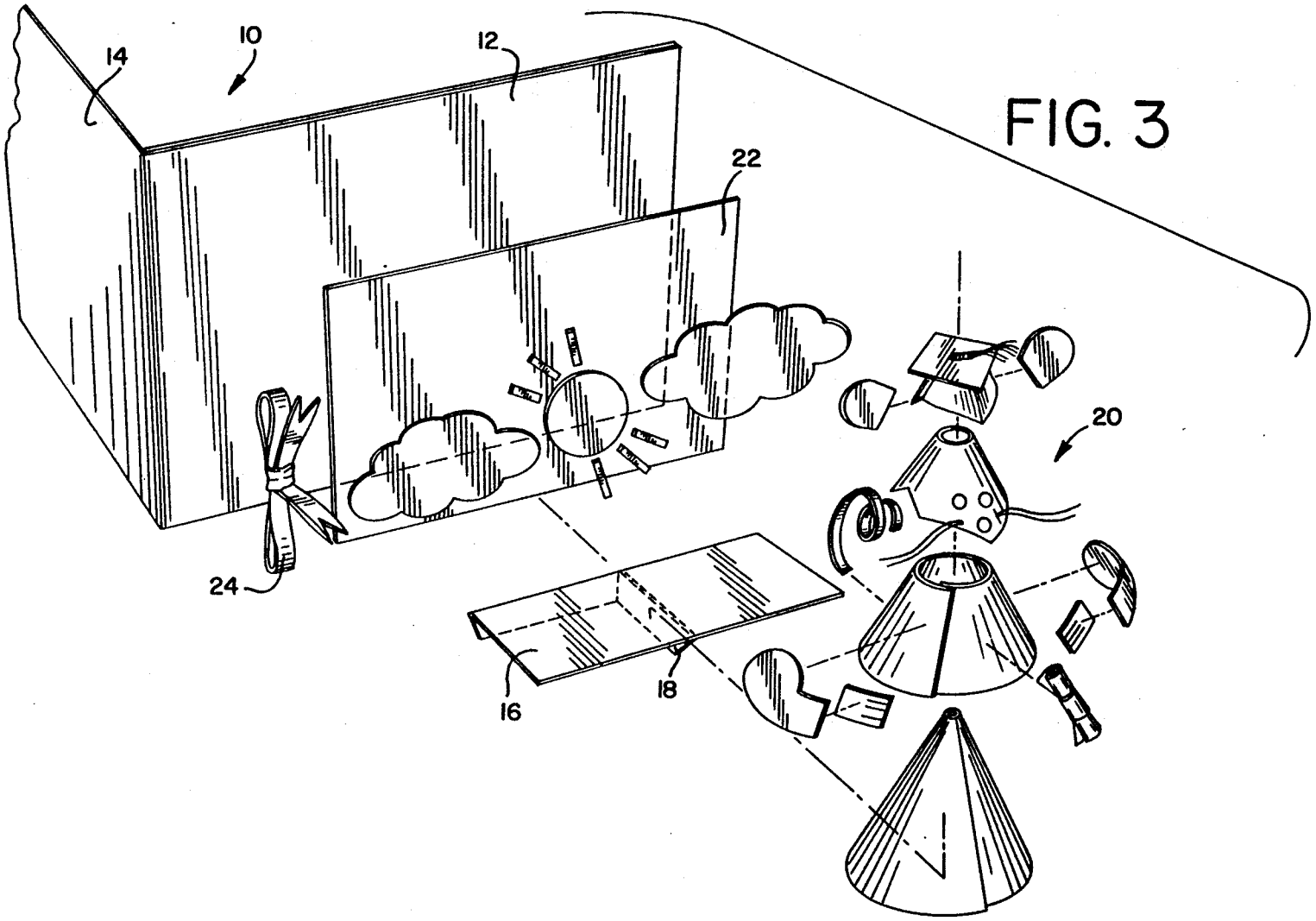
FIG. 3 is an exploded view of the greeting card of FIG. 1.

Preferably, a means for supporting the shelf is provided, as best seen in FIGS. 2 and 3. The support means 18 preferably is attached to both the front face of the front panel 12 and the under side of the shelf 16*b*. The support means can be attached to the front face of the front panel and to the under side of the shelf 16*b* by any well known means as described herein.

In one embodiment, the support means 18 has an "L" shape wherein a portion of the L is attached to the front face of the front panel 12 and wherein the lower side of the shelf 16 rests upon the support means. In another embodiment, the shelf 16 and the support means 18 are formed as one piece. Of course other shapes and configurations to provide a support means can be used. For example, the L shaped support means may be formed of a single piece or of two pieces, the support means may have a "T" shape or an angled brace.

A character object 20 rests on or can be placed on the upper side of the shelf 16. It is preferred that the height of the character object be such that when it is placed on the shelf it does not extend beyond the top edge 12*a*. Of course, one or more character objects may be placed on the upper side of shelf 16*a* and will be dictated by the dimensions of the shelf. In a preferred embodiment, best seen in FIG. 3, the character object 20 has a substantially conical body shape. In the most preferred embodiment, the character object 20 has a conical body and is comprised of paper.

Of course, the character object 20 can have other shapes which are pleasing to consumers or which are dictated by manufacturing considerations. For example, the character object shape can be rectilinear, circular, triangular and the like.

In the most preferred embodiment, the character object has the appearance of mouse. Other appearances that may be used include, but are not limited to, animals including farm animals such as cows, pigs, horses, chickens, dogs, cats, and the like, and humans and humanoid as well as other known objects.

In addition, other objects may be placed on the shelf to provide a "scene." For example, one or more character objects may be placed on the shelf along with one or more scenery objects. Such objects can include trees, shrubbery, fences, and can include any such object which may be pleasing to the consumer or recipient.

It is preferred that the character object 20 be held stationary or be secured on the upper side of the shelf 16*a* so that it is not lost or destroyed. Accordingly, means for retaining the object 20 on the upper side of the shelf 16*a* is provided. Any well known means of retaining such as adhesive, adhesive tape, glues, staples, epoxy, and the like may be used. Preferably, when the greeting card 10 is made of paper, the retaining means includes, but is not limited to, glue or other adhesive, staples and the like.

A scenic background 22 may be provided by any means well known to those skilled in the art on the front face of the front panel as desired to enhance the visually pleasing aspects of the greeting card. In one embodiment, the scenic background 22 is attached to the front face of the front panel 12, with an adhesive or the like. Preferably, the scenic background 22 has dimensions that are somewhat smaller than the overall dimensions of the front panel so that the scenic background 22 may be provided thereon.

A decorative object 24 such as a ribbon or the like may also be provided on the front face of the front panel 12.

In the most preferred embodiment, the greeting card 10 is constructed of paper with the front panel 12 and the rear panel 14 being of one piece and hinged along line 13. Top edge 12*a* and bottom edge 12*c* are about 5 inches and side edges 12*b* and 12*d* are about 4 inches. The shelf 16 is rectangular, of one piece, and extends out from the front face of the front panel 12 about 1.5 inches with a length about 3 inches. The shelf is attached to the front face with an adhesive and is located about 1 inch from the bottom edge 12*c* and is centered with respect to side edges 12*b* and 12*d*. The character object is conical with the appearance of a mouse and is about 2 inches tall.

Of course, it should be understood that a wide range of changes and modifications can be made to the embodiments described above. It is therefore intended that the foregoing description illustrates rather than limits this invention, and that it is the following claims, including all equivalents, which define this invention.

I claim:

1. A greeting card comprising:

a. a front panel with at least one edge, a front face, and a rear face;

b. a rear panel with a front face, a rear face, and at least one edge joined to an edge of the front panel such that when the card is in a closed position the front face of the rear panel is adjacent the rear face of the front panel;

c. a one-piece shelf and means for supporting the shelf, with the shelf being attached only to the front face of the front panel, the shelf having an upper side and an under side, the support means attached to the front face of the front panel and to the under side of the shelf; and d. at least one character object secured only to the upper side of the shelf.

2. The greeting card of claim 1 wherein the front panel and rear panel are comprised of one piece.

3. The greeting card of claim 1 wherein the character object has a substantially conical shape.

4. The greeting card of claim 1 wherein the card further contains a filler sheet disposed between the front face of the rear panel and the rear face of the front panel.

5. A greeting card comprising:

a. a front panel with a front face, a rear face, a top edge, a bottom edge, a first side edge, and a second edge;

b. a rear panel having a front face, a rear face, a top edge, a bottom edge, a first side edge, and a second edge, with one edge joined to an edge on the front panel such that when the card is in a closed position the front face of the rear panel is adjacent the rear face of the front panel and each of the edges of the front panel are substantially aligned with the like edges of the rear panel;

c. a one-piece shelf and means for supporting the shelf with the shelf being attached only to the front face of the front panel, the shelf having an upper side and an under side, the support means attached to the front face of the front panel and to the under side of the shelf; and, d. a character object secured only to the upper side of the shelf by a means for retaining.

6. The greeting card of claim 5 wherein the front panel and the rear panel are comprised of one piece.

7. The greeting card of claim 5 wherein the character object is conical.

8. The greeting card of claim 5 wherein the greeting card further contains a filler sheet disposed between the front panel and the rear panel.

9. A greeting card comprising:

a. a front panel with a front face, a rear face, a top edge, a bottom edge, a first side edge, and a second edge, the top and bottom edge being about 5 inches and the first and second side edges being about 4 inches;

b. a rear panel having a front face, a rear face, a top edge, a bottom edge, a first side edge, and a second edge, with one edge hinged to an edge on the front panel such that when the card is in a closed position the front face of the rear panel is adjacent the rear face of the front panel and each of the edges of the front panel are substantially aligned with the like edges of the rear panel;

c. a shelf attached only to the front face of the front panel at about 1 inch from the bottom edge of the front panel, the shelf having an upper side and an under side and extending outward from the front panel about 1.5 inches, the shelf further comprising an integral means for supporting the shelf which is attached to the front face of the front panel and to the under side of the shelf; and, d. a character object secured only to the upper side of the shelf by a means for retaining, the character object being substantially conical and having a height of about 2 inches.

10. The greeting card of claim 9 further having a filler sheet disposed between the front panel and the rear panel.

* * * * *